United States Patent [19]

Voris

[11] 4,357,011

[45] Nov. 2, 1982

[54] ADAPTING STRUCTURE FOR EXERCISE MACHINES

[75] Inventor: Harvey C. Voris, Rancho Palos Verdes, Calif.

[73] Assignee: Paramount Health Equipment Corporation, Los Angeles, Calif.

[21] Appl. No.: 271,486

[22] Filed: Jun. 8, 1981

[51] Int. Cl.[3] ..... A63B 21/06

[52] U.S. Cl. ..... 272/118; 272/143

[58] Field of Search ..... 272/118, 117, 130, 134, 272/138, 142, 143

[56] References Cited

U.S. PATENT DOCUMENTS

| | | | |
|---|---|---|---|
| 3,820,782 | 6/1974 | Salkeld | 272/118 |
| 4,010,947 | 3/1977 | Lambert | 272/118 |
| 4,241,913 | 12/1980 | Zwayer et al. | 272/130 |

OTHER PUBLICATIONS

"Soloflex"-Playboy Magazine, Dec. 1980, p. 297.

*Primary Examiner*—Richard C. Pinkham
*Assistant Examiner*—William R. Browne
*Attorney, Agent, or Firm*—Nilsson, Robbins, Dalgarn, Berliner, Carson & Wurst

[57] ABSTRACT

A pair of adaptors each has a tubular structure mountable to a gripping portion of a press bar for rotation between substantially opposite conditions. The adaptors are provided with opposed structures for engaging a user's shoulders and the bottoms of a user's feet, respectively, to perform distinct exercises in the two conditions. Rotational motion of the tubular structures permits a preselected limited range of movement of the adaptors so as to shoulder engaging portions of the adaptors to engage the shoulders of a user when in one position of rotation and to engage the feet of a user when in another position of rotation.

10 Claims, 11 Drawing Figures

FIG. 4A
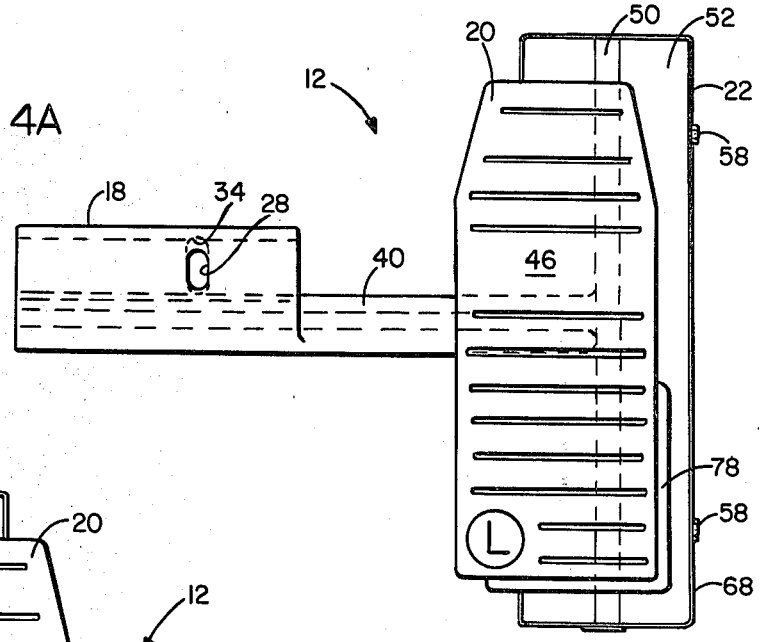
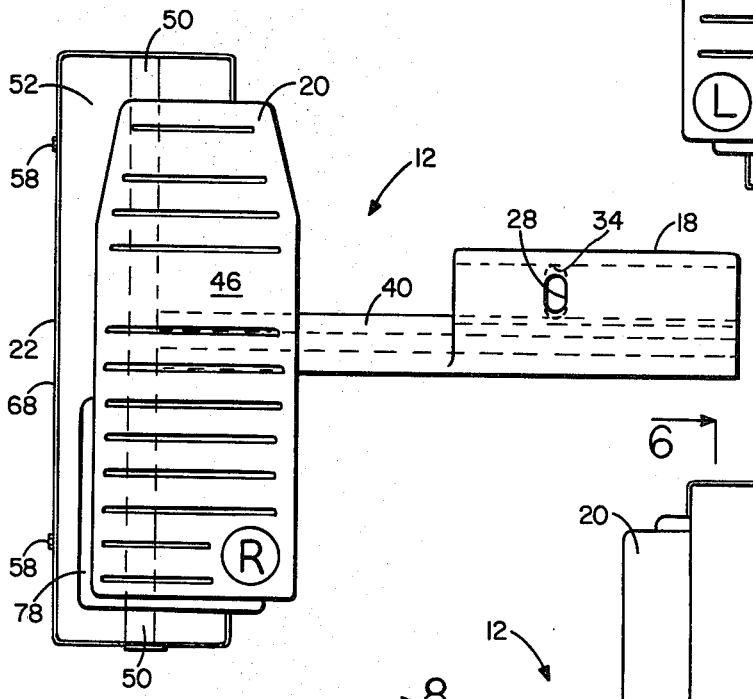
FIG. 4B
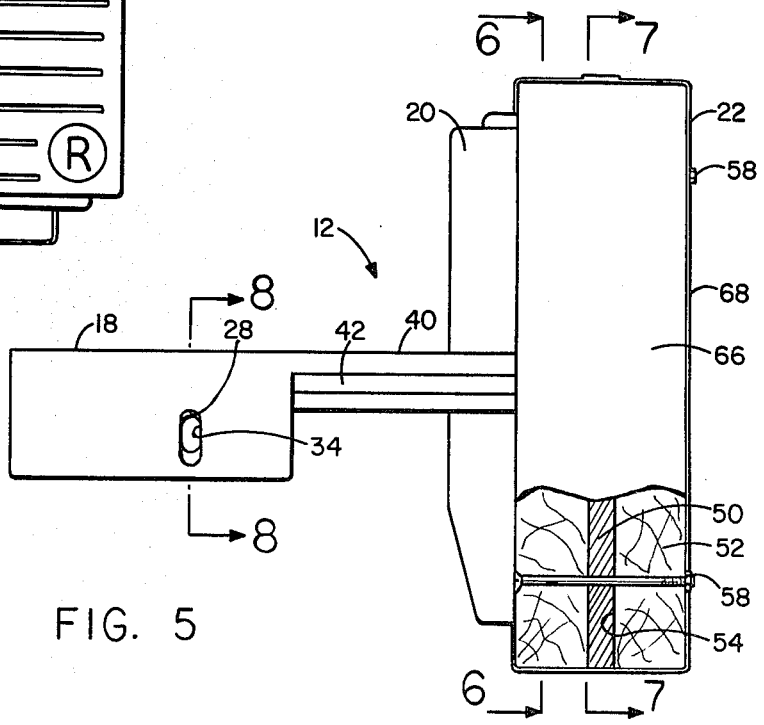
FIG. 5

ADAPTING STRUCTURE FOR EXERCISE MACHINES

BACKGROUND OF THE INVENTION

This invention relates generally to the exercise art and, more particularly, to an improved structure for adapting a press bar of an exercise machine to the performance of squat and leg press exercises.

A number of prior weight resistance exercise machines have been provided with one station designed specifically for performance of squat exercises and another station designed specifically for performance of leg press exercises. The squat stations generally include a pair of downwardly facing pads fixed at the outer end of a weight actuating member for engagement with the upper surfaces of a person's shoulders. Likewise, the leg press stations generally have a pair of upwardly facing foot pedals mounted at the end of a weight actuating member. However, individual stations of this type are expensive to manufacture and can substantially increase the physical size of an exercise machine.

Because the shoulder pads and foot pedals of such individual stations are fixed relative to the corresponding weight actuating member, and the weight actuating member generally pivots about a fixed axis to raise and lower the weights of the machine, the orientation of the shoulder pads and foot pedals can change relative to a user during the course of an exercise. This causes discomfort for the user and forces him to execute an unnatural motion.

Another type of weight machine is constructed in a manner permitting a press station to be converted to a squat or leg press station by removing the entire press bar therefrom and attaching either a shoulder pad arrangement or a foot pedal arrangement in place of the press bar. While machines of this type are less costly than machines having entirely separate squat and leg press stations, the shoulder and foot pedal assemblies are rather bulky and difficult to interchange with the press bar in the midst of an exercise program. Furthermore, the shoulder pads and foot pedals of this type of machine are also fixed relative to a weight actuating member. However, this does not constitute a serious problem in these machines because the weight actuating member is usually constructed so that it does not pivot.

Therefore, it is desirable to provide an apparatus for performing squat and leg press exercises on a weight resistance exercise machine without unduly increasing the size or cost of the machine.

SUMMARY OF THE INVENTION

The present invention comprises an improved apparatus for performing squat and leg press exercises on exercise machines having press bars which are actuable substantially vertically and which terminate at two sides thereof in substantially cylindrical horizontal gripping portions. The apparatus comprises a pair of adaptors which are mirror images of each other and include tubular means slidably receivable over the gripping portions of the press bar and rotatable between first and second substantially opposite conditions thereon.

The adaptors also include means for engaging the upper surface of a user's shoulder and the first condition of the tubular means and means for engaging the sole of a user's foot in the second condition of the tubular means. The shoulder engagement means and the foot engagement means are positioned essentially back to back and are connected to the tubular means such that substantially upward forces applied to the shoulder and foot engagement means during use are directed perpendicularly relative to the tubular means. Substantially upward forces can thus be applied to the press bar of a weight machine through the shoulders or feet of a user to perform squat or leg press exercises, respectively.

The apparatus may also include means for permitting rotational motion of the tubular means within preselected limited ranges when the tubular means is in the first and second conditions, respectively. This rotation permitting means may take the form of a first arcuate slot registrable with an opening in the press bar when the tubular means is in the first condition and a second arcuate slot registrable with an opening in the press bar when the tubular means is in the second condition, and retaining pin means engageable in each of these conditions with one of the slots and with the corresponding opening in the press bar. The preselected ranges of rotational motion of the adaptors is thus determined by the length of the corresponding slot, such that the motion compensates for any arcuate component of press bar movement to permit the user to execute a natural squat or leg press motion. The ranges of motion of the tubular means in the first and second conditions thereof may be approximately 25 and 40 degrees, respectively.

The adaptors of the present invention are thus quickly and easily mountable to the existing press bar of virtually any weight resistance exercise machine having a pair of substantially cylindrical horizontal gripping portions of the appropriate diameter. The only modification necessary to fully mount the adaptors to a machine of this type is to provide a diametrically directed opening in the press bar, if desired, for locating the adaptors in the first or second conditions thereof. Each of the two adaptors is light in weight and easy to handle, permitting them to be either mounted or dismounted relative to the press bar during an exercise routine. The small physical size of the adaptors and the fact that they permit both squat and leg press exercises to be performed with a conventional press bar serve to alleviate the space problem which can be of considerable importance in machines designed for home use.

Additionally, the adaptors of the present invention alleviate a longstanding problem of squat and leg press mechanisms in which a weight actuating member of the exercise machine is mounted for pivotal movement relative to a point in the machine. This type of actuating member is common in weight resistance exercise machines and causes the shoulder pads or foot pedals fixed to the end thereof to trace the same arc as the actuating member. The shoulder pads and foot pedals thus travel arcuately during the course of an exercise and in so doing can change their angular orientation relative to the user's body. However, the ability of the adaptors of the present invention to pivot within a preselected range compensates for any arcuate component of press bar movement during the course of an exercise. The angular orientation of the adaptors relative to the user therefore remains essentially constant, permitting the user to execute a comfortable squat or leg press motion.

BRIEF DESCRIPTION OF THE DRAWINGS

The above and other objects of the present invention may be more fully understood from the following detailed description taken together with the accompanying drawings wherein similar reference characters refer to similar elements throughout and in which:

FIGS. 4A and 4B are top plan views of the left hand side adaptor and the right hand side adaptor, respectively, of FIGS. 1A, 1B, 2A and 2B;

FIG. 5 is a bottom plan view, partially broken away, of the left hand side adaptor of FIG. 4A;

DESCRIPTION OF THE PREFERRED EMBODIMENTS

Figures 1A, 1B, 2A, 2B:
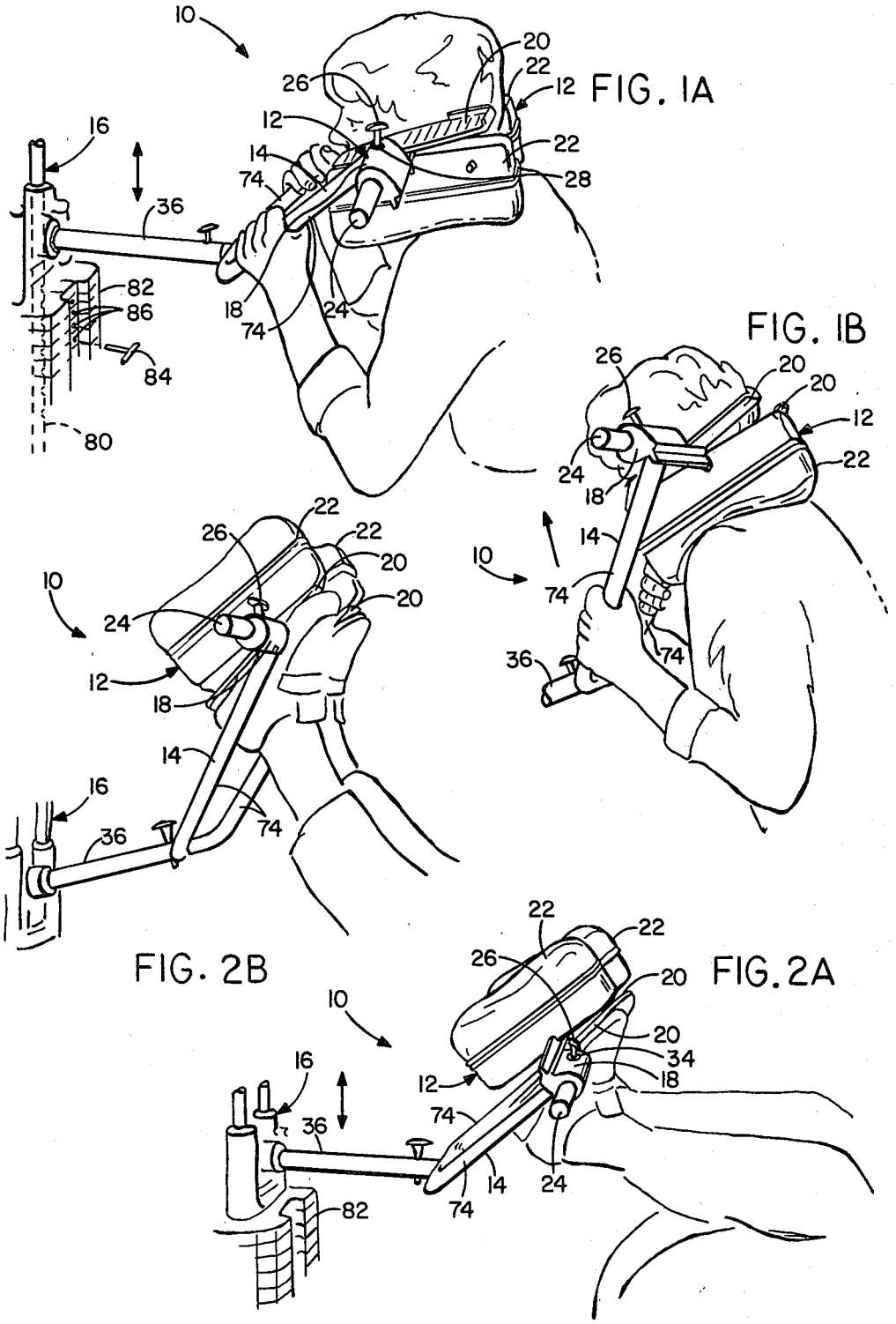
FIG. 1A is a perspective view showing an apparatus constructed in accordance with the present invention and mounted to a weight resistance exercise machine, in the first condition of the apparatus and the initial condition of the exercise machine.
FIG. 1B is a perspective view showing the apparatus and weight machine of FIG. 1A in the fully raised condition of the exercise machine.
FIG. 2A is a perspective view of the apparatus and exercise machine of FIG. 1A in the second condition of the apparatus and the initial condition of the exercise machine.
FIG. 2B is a perspective view showing the apparatus and exercise machine of FIG. 2A in the fully raised condition.

Referring now to the drawings, there is illustrated, in FIGS. 1 and 2 thereof, an apparatus embodying the present invention, generally designated 10. The apparatus 10 includes a pair of adaptors 12 mountable to the press bar 14 of a weight resistance exercise machine 16. The adaptors 12 are mirror images of each other and each of the adaptors comprises generally a tubular section 18 connected to a foot pedal 20. A shoulder pad assembly 22 is arranged in back to back relationship with the foot pedal 20.

The tubular sections 18 are receivable over a pair of cylindrical gripping portions 24 of the press bar 14 and rotatable thereon between two conditions of operation. In the first condition, illustrated in FIGS. 1A and 1B, the shoulder pad assemblies 22 are directed downwardly for engagement with the upper surfaces of a user's shoulders. The adaptors 12 are locked in this condition by a pair of retaining pins 26 which pass through corresponding slots 28 in the tubular section 18 to engage a pair of openings 30 of the gripping portions 24. The adaptors 12 are thus permitted to rotate relative to the gripping portions 24 through a preselected angle corresponding to the length of the slots 28. This limited range of rotational motion permits the shoulder pad 22 to remain substantially horizontal during a squatting exercise despite the fact that the press bar 14 is itself rotating about a distant point in the apparatus.

In the second condition of the apparatus, shown in FIGS. 2A and 2B, the foot pedals 20 of the apparatus are faced generally downwardly for engagement with the upwardly facing soles of the user's feet. The apparatus is placed in this condition by withdrawing the retaining pins 26 and rotating the adaptors 12 upwardly and backwardly through an angle of approximately 180 degrees. The adaptors are held in this position by reinsertion of the retaining pins 26 through a second pair of slots 34 of the tubular sections 18 for engagement with the openings 30. In this condition, the adaptors 12 are permitted to rotate through a second range of motion determined by the length of the slots 34. This range is selected to permit travel of the press bar 14 between the conditions of FIGS. 2A and 2B while maintaining the angular orientation of the foot pedals 20 relative to the user 32 essentially constant.

As shown most clearly in FIGS. 1A and 1B, the weight resistance exercise machine 16 to which the adaptors 12 are mounted includes an elongated weight actuating member 36 mounted for pivotal movement about an axis (not shown) within the machine 16. The weight actuating member 36 pivots between the initial position of FIG. 1A and the raised condition of FIG. 1B, constantly changing the orientation of the press bar 14 as it does so.

The structure of the adaptor 12 positioned on the left hand side of the press bar 14 is shown in detail in FIGS. 3, 5, 6, 7 and 8. Because the two adaptors 12 are mirror images of each other, the following description of the left hand adaptor is equally applicable to the structure of the right hand adaptor. To avoid repetition, the right hand adaptor will not be separately described in detail herein.

Figure 3:
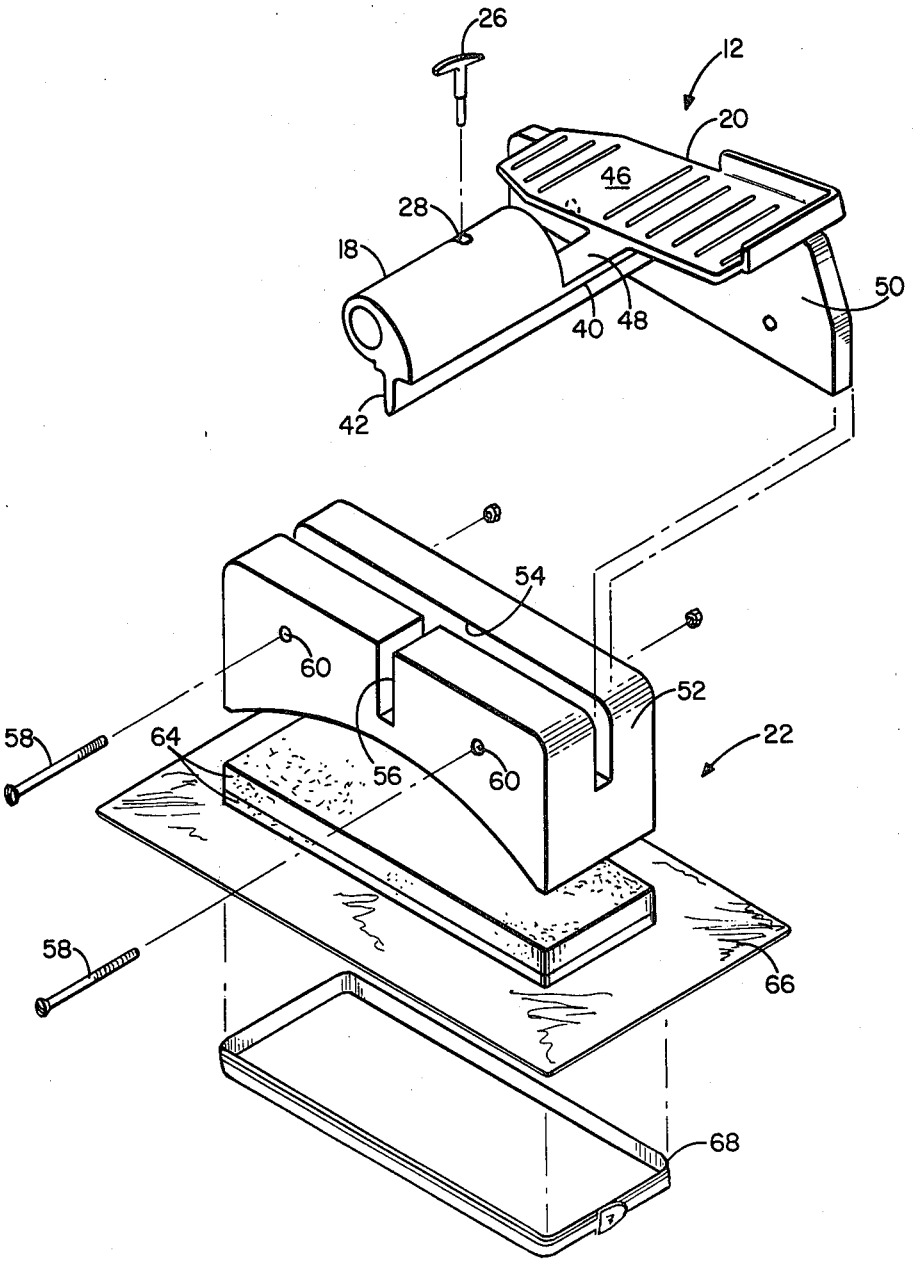
FIG. 3 is an exploded perspective view of the left hand side adaptor of FIGS. 1A, 1B, 2A and 2B.

As seen most clearly in FIG. 3, the tubular section 18 of the adaptor 12 is connected to the foot pedal 20 by an elongated support portion 40 which is generally parallel to the tubular section 18 and perpendicular to the length of the foot pedal 20. The support portion 40 is substantially "T" shaped in cross section for additional strength, with a central projection 42 of the "T" extending essentially away from the tubular section 18. An upper surface 46 of the foot pedal 20 is substantially parallel to a flat upper surface 48 of the portion 40. The foot pedal 20 is further provided with a longitudinal rib 50 depending from the underside of the foot pedal 20. The support portion 40 extends to and terminates at the longitudinal rib 50.

The tubular section 18 is provided with an axial passage 44 for sliding reception of the gripping portions 24 described above. The passage 44 is offset laterally relative to the support portion 40 to permit a desired range of rotational motion of the adaptor 12 without interference between the adaptor and the press bar 14.

As seen in FIGS. 3, 5, 6 and 7, the shoulder pad assembly 22 includes a central block 52 having a pair of perpendicular slots 54 and 56 for reception of the longitudinal rib 50 and the central projection 42 of the support element 40. The block 52 is anchored in engagement with the longitudinal rib 50 by a pair of bolt assemblies 58 extending through aligned openings 60 and 62 of the block 52 and the rib 50, respectively. The lower surface of the block 52 is longitudinally concave in shape and is upholstered with a plurality of layers of foam 64, a sheet of covering material 66 and a trim strip 68.

As seen most clearly in FIG. 5, the longitudinal rib 50 is offset relative to the center of the foot pedal 20 in a direction away from the tubular section 18. This offset rib structure interfits with the center slot 54 of the block 52 to locate the shoulder pad assembly 22 off center relative to the foot pedal 20. In the context of FIGS. 1A and 2A, the shoulder pad assemblies 22 are located further inwardly from the gripping portions 24 than are the foot pedals 20, causing the spacing between the shoulder pad assemblies to be less than that between the foot pedals. This difference in spacing is provided to account for the difference between the most comfortable location of the pad assemblies 22 on a user's shoulders and the most natural spacing of an average user's feet during a leg press exercise. In practice, it has been found that the most comfortable center-to-center spacing of the shoulder pad assemblies 22 is $9\frac{7}{8}$ in the case of most individuals. This permits the stress from the pad assemblies 22 to be borne inwardly of the gleno-humeral joint of each shoulder, minimizing discomfort. The corresponding optimum spacing of the centers of the foot pedals 20 has been found to be $11\frac{1}{2}$ inches.

Figure 6:
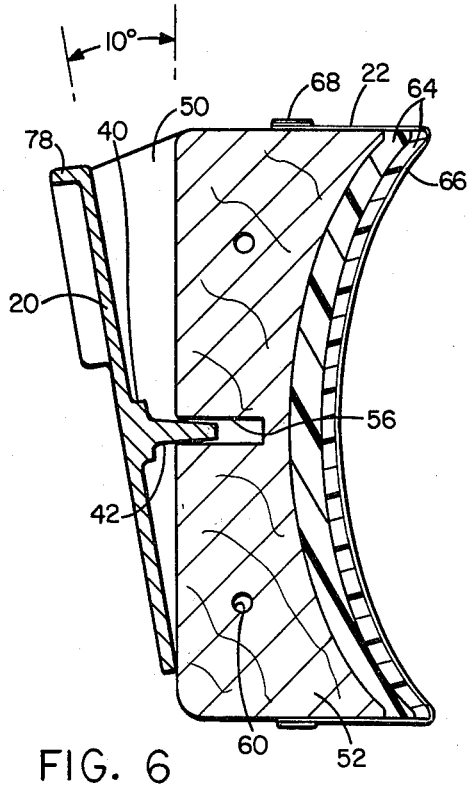
FIG. 6 is a vertical sectional view taken along the line 6—6 of FIG. 5.
Figure 7:
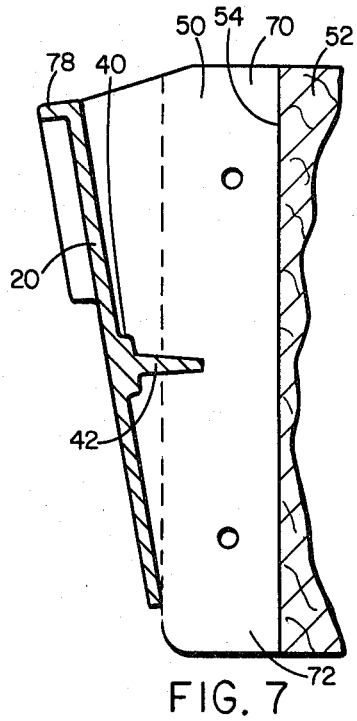
FIG. 7 is a vertical sectional view taken along the line 7—7 of FIG. 5.
Figure 8:
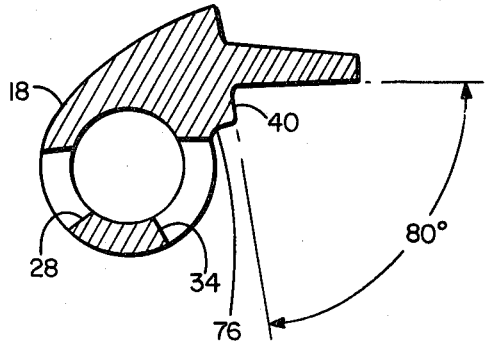
FIG. 8 is a vertical sectional view taken along the line 8—8 of FIG. 5.

Referring now to FIGS. 6 and 7, the shoulder pad assembly 22 is angled slightly relative to the foot pedal 20. This angle is preferably approximately 10 degrees. The slot 56 of the central block 52 then extends perpendicularly into the block, while the central projection 42 received therein is canted 10 degrees from perpendicular relative to the foot pedal 20. Implementation of these angular relationships is accomplished in part by providing the longitudinal rib 50 of the foot pedal 20 with a greater depth at its upper end 70 than at its lower end 72. The rib 50 extends a uniform distance into the slot 54 and is held therein by the bolt assemblies 58 described above.

The 10 degree angle of the shoulder pad assemblies 22 relative to the foot pedals 20 permits a greater range of relative movement of the adaptors 12 during performance of a squat exercise. Without this angle, it was found that the elongated support portion 40 of each adaptor 12 tended to collide with a pair of members 74 connecting the gripping portions 24 of the press bar 14 together. The members 74 extend a substantial distance perpendicularly from the gripping portions 24 to define an open area between the gripping portions. As the press bar 14 is raised during a squat exercise, the shoulder pad assemblies 22 are urged inwardly toward the exercise machine 16 to compensate for pivotal movement of the weight actuating member 36. As the shoulder pad assemblies 22 pivot toward the exercise machine 16, the elongated support portions 40 similarly pivot toward and eventually against the members 74. This interference between the support portions 40 and the members 74 undesirably limits compensating rotational motion of the adaptors 12 in the first condition of the apparatus. With the shoulder pad assemblies angled 10 degrees toward the weight machine 16 in this condition, a total angular movement of 25 degrees relative to the gripping portions 24 is permitted between the initial position of the each assembly 22 shown in FIG. 1A and the final position shown in FIG. 1B.

Calculations based on the average body dimensions of a 50th percentile adult male have indicated that rotational movement of the pad assemblies 22 through an angle of 20 degrees between the conditions of FIGS. 1A and 1B would suit the needs of an adult male falling within the 50th percentile on the basis of physical size. This range of movement is therefore acceptable for use by a majority of users, with every little deviation from the optimal orientation of the pad assemblies 22 and without permitting a wide enough range of rotational motion to cause the pad assemblies to slip off a user's shoulders. The length of the slot 28 has been determined on the basis of providing a desired 20 degree range of motion of the adaptors 12 during performance of a squat exercise, with approximately 5 degrees of additional rotational travel of the pad assemblies 22 outwardly from the exercise machine 16 in the condition of FIG. 1A. The pad assemblies 22 are thus permitted to swing outwardly 5 degrees beyond the horizontal condition to permit a user to more easily assume the position illustrated in FIG. 1A. Assuming that the gripping portions 24 are one inch in diameter and that the tubular sections 18 are $\frac{1}{4}$ of an inch thick at the locations of the slots, the slots 28 are preferably $\frac{5}{8}$ of an inch long when measured at the exterior surfaces of the tubular sections. Approximately $\frac{1}{8}$ of an inch of this travel is attributable to the five degrees of additional outward travel of the pad assemblies 22.

The optimum range of rotational motion of the adaptors 12 in the second condition of the apparatus 10 has likewise been chosen to accommodate the greatest number of potential users. However, this determination is complicated by the fact that the finishing angle of a user's legs is dependent upon the initial positioning of the user with respect to the foot pedals 20. Because the finishing leg angle will vary considerably among users, the adaptors 12 are given a relatively large range of motion in the second condition of the apparatus 10. A range of approximately 40 degrees has been found to be optimum for most purposes, while avoiding interference between the retaining pins 26 and the elongated support elements 40 in the fully extended condition of the user's legs. Again assuming gripping portions 24 which are one inch in diameter and tubular sections 18 which are $\frac{1}{4}$ of an inch thick, this range of travel of the foot pedals 20 in the second condition of the present invention is achieved with slots 34 which are one inch long. As shown most clearly in FIG. 8, each of the slots 34 extends circumferentially about the corresponding tubular section 18 from a location directly adjacent to a fillet 76 which is located between the tubular section 18 and the continuation of the support portion 40.

Various dimensions of adult males falling within the 50th percentile on the basis of physical size are obtainable, for the purposes described herein, from published tables of anthropometric data. The particular source used in designing and dimensioning the apparatus of the present invention is Human Engineering Guide To Equipment Design, 1972 Edition, edited by VanCott and Kinkade. Retention of a user's feet relative to the foot pedals 20 in the second condition of the apparatus 10 is facilitated by a peripheral lip 78 extending a short distance above the surface 46 of each of the foot pedals 20. In the orientations of FIGS. 4A and 4B, each of the peripheral lips 78 extends along the lower edge of the corresponding foot pedal 20 in a direction opposite the tubular section 18, and curves upwardly a substantial distance along the side edge of the foot pedal. In the second condition of the apparatus 10, illustrated at FIGS. 2A and 2B, the peripheral lips 78 of the foot pedals 20 serve to prevent the feet of a user from sliding downwardly or inwardly relative to the foot pedals during performance of leg extension exercises. The outer edges of the foot pedal 20, from the viewpoint of the user, are protected by the members 74 of the press bar 14 to prevent the user's feet from sliding in that direction.

For ease of manufacture, the tubular section 18, the foot pedal 20, and the support portion 40 of each of the adaptors 12 can be made as a single casting of aluminum or other suitable material. A casting of this type is relatively inexpensive and yields an adaptor which is light in weight and easy to handle. The control block 52 is preferably made of wood or plastic.

In operation, the pair of adaptors 12 can be mounted to the press bar 14 of the weight machine 16 by simply sliding the tubular sections 18 thereof over the gripping portions 24 of the press bar. During installation, the adaptors 12 are rotated upwardly through an angle of between 45 and 90 degrees to allow the foot pedals 20 and the shoulder pad assembly 22 to clear the members 74 of the press bar, and are then rotated downwardly through the same angle to assume the position of the adaptor 12 at the right hand side of FIG. 1A. The pins 26 are then passed through the slots 28 and the openings 30 to lock the adaptors in the first condition of the apparatus 10 while permitting the shoulder pad assemblies 22 to rotate through an angle of approximately 25 degrees. The adaptors 12 are then engageable with the upper surfaces of a user's shoulders, as shown in FIG. 1A, for performance of a series of squat exercises. In the course of these exercises, the press bar 14 is repeatedly raised and lowered between the conditions of FIGS. 1A and 1B, the adaptors 12 rotating continuously relative to the gripping portions 24 to compensate for rotational motion of the press bar 14 and maintain the shoulder pad assemblies 22 as close to horizontal as possible. This condition of the pad assemblies 22 provides secure and comfortable support of the pad assemblies on the user's shoulders. At the same time, the slots 28 of the tubular sections 18 serve to limit the extent of rotation of the adaptors 12, preventing the shoulder pad assemblies 22 from pivoting excessively to a point at which they might slip off the user's shouldrs.

The apparatus 10 is then placed in condition for performance of leg press exercises by removal of the pins 26 and rotation of the adaptors 12 upwardly and backwardly relative to the exercise machine 16 to the condition of FIGS. 2A and 2B. The pins 26 are then reengaged with the slots 34 and the openings 30 to retain the adaptors in the condition of FIGS. 2A and 2B while permitting rotational motion thereof within a limited range. An individual desiring to perform leg press exercises then assumes a position on his back, supported by a bench or the like, with his legs and feet directed upwardly againt the adaptors 12 as shown in FIGS. 2A and 2B. Leg press exercises are performed in this position by a repeatedly straightening the legs in an upward direction to the position of FIG. 2B. During the course of these exercises, the adaptors 12 are permitted to rotate relative to the gripping portions 24 to compensate for rotational motion of the press bar 14 and the weight actuating member 36. During these exercises, the feet of the user are retained in position relative to the foot pedals 20 by the outer lips 78 of the foot pedal and by the members 74 of the press bar.

The exercise machine 16 of the apparatus 10 may take the form of virtually any commercially available exercise machine. A machine of this type is commonly provided with a perforated rod 80 actuable up and down through a weight stack 82 as the weight actuating member 36 is raised and lowered in the course of an exercise (see FIG. 1A). The desired amount of weight from the stack 82 is selected by inserting a pin 84 horizontally through one of a number of openings 86 in the weight stack 82 to engage a corresponding one of the perforations in the rod 80. If a different starting position from that shown in FIG. 1A or 1B is desired, the pin 84 can be disengaged from the weight stack and the actuating member 36 can be raised to expose a portion of the rod 80 above the weight stack. A second pin 88 can then be engaged with one of the perforations of the rod 80 to maintain the apparatus in a slightly raised condition after the actuating member 36 is released. The pin 84 can then be passed through the appropriate opening 86 of the weight stack 82 to select the desired amount of weight. For this purpose, and to permit each of the weights in the weight stack 82 to be used after the apparatus 10 has been preset in the above-described manner, the perforated rod 80 may be made long enough to extend to the base of the weight stack 82 in the preset condition. A portion of the rod 80 will then extend downwardly beyond the bottom of the weight stack 82 when the apparatus 10 is in the lowermost condition.

From the above, it can be seen that there has been provided an improved structure for adapting the press bar of a weight resistance exercise machine to the performance of either squat or leg press exercises without the removal of the press bar, the attachment being permitted to rotate through preselected ranges during squat and leg press exercises, respectively, to compensate for any arcuate motion of the press bar.

What is claimed is:

1. Apparatus for aiding in performing squat and leg press exercises on exercise machines having press bars actuable substantially vertically and terminating at two sides thereof in substantially cylindrical horizontal gripping portions, comprising:

a pair of body engaging adaptors mounted on the respective gripping portions of said press bar, said adaptors being mirror images of each other, each said adaptor comprising:

tubular means for transmitting a user's force, said tubular means slidably receivable over a gripping portion of the press bar and rotatable thereon between first and second substantially opposite positions for two different exercises;

means for engaging the upper surface of a user's shoulder when in said first position of said tubular means; and means for engaging the sole of a user's foot in said second position of said tubular means;

said shoulder engagement means and said foot engagement means being positioned essentially back to back and connected to said tubular means such that substantially upward forces may be applied to said shoulder engagement means during one exercise to said foot engagement means during a different exercise, said forces being directed substantially perpendicular to said tubular means;

whereby substantially upward forces will be applied to the press bar of a weight machine through the shoulders or feet of a user when performing squat or leg press exercises, respectively.

2. Apparatus as recited in claim 1 which includes means for permitting rotational motion of said tubular means within preselected limited ranges when said tubular means is in said first and second positions, respectively, such that said rotational motion compensates for any arcuate component of press bar movement to permit the user to execute a natural squat or leg press motion.

3. Apparatus as recited in claim 1 wherein each of said tubular means defines a first arcuate slot registrable with an opening in each press bar when said tubular means is in said first position and a second arcuate slot registrable with an opening in the press bar when said tubular means is in said second positions, and which further comprises retaining pin means engageable in each of said positions with one of said slots and the opening in the press bar with which it registers, such that rotational motion of said tubular means and said adaptors is permitted in each of said positions within a preselected range determined by the length of the corresponding slot.

4. Apparatus as recited in claim 3 wherein said preselected ranges of motion are selected to compensate for any arcuate component of press bar movement, permitting the user to execute a squat or leg press motion.

5. Apparatus as recited in claim 4 wherein said preselected range of motion in said first position is approximately twenty-five degrees.

6. Apparatus as recited in claim 4 wherein said preselected range of motion in said second position is approximately forty degrees.

7. Apparatus as recited in claim 1 and intended for use with press bars having a pair of spaced apart gripping portions connected by members extending a substantial distance perpendicularly therefrom to define an open area between the gripping portions, wherein said adaptors are constructed and arranged to locate said shoulder and foot engagement means adjacent the gripping portions and essentially therebetween.

8. Apparatus as recited in claim 7 wherein said shoulder and foot engagement means are connected to said tubular means by an elongated support structure substantially parallel to said tubular means.

9. Apparatus as recited in claim 1 wherein said shoulder engagement means defines a shoulder engaging surface and said foot engagement means defines a foot engaging surface, said shoulder and foot engaging surfaces facing in opposite directions from each other and forming an angle of approximately ten degrees with one another.

10. Apparatus for performing squat and leg press exercises comprising:

an exercise machine having a press bar actuable substantially vertically and terminating at two sides thereof in substantially cylindrical horizontal gripping portions;

a pair of body engaging adaptors mounted on said gripping portions respectively, said adaptors being mirror images and each of said adaptors comprising:

tubular means for transmitting a user's force, said tubular means slidably receivable over one of said gripping portions and rotatable thereon between first and second substantially opposite positions for the different exercises;

means for engaging the upper surface of a user's shoulder when in said first position of said tubular means; and means for engaging the sole of a user's foot in said second position of said tubular means;

said shoulder engagement means and said foot engagement means being positioned essentially back to back and connected to said tubular means such that substantially upward forces may be applied to said shoulder engagement means during one exercise and to said foot engagement means during a different exercise, said forces being directly substantially perpendicular to said tubular means;

whereby substantially upward forces will be applied to said press bar through the shoulders or feet of a user when performing squat or leg press exercises, respectively.

* * * * *

UNITED STATES PATENT AND TRADEMARK OFFICE

CERTIFICATE OF CORRECTION

PATENT NO. : 4,357,011

DATED : November 2, 1983

INVENTOR(S) : HARVEY C. VORIS

It is certified that error appears in the above-identified patent and that said Letters Patent are hereby corrected as shown below:

Abstract,

Line 9, after "to" insert --cause the--.

Column 7, line 30, "shouldrs" should be --shoulders--.

Column 8, line 47, after "exercise" insert --and--.

Column 8, line 66, "positions" should be --position--.

Signed and Sealed this

*Fourteenth* Day of *June 1983*

[SEAL]

*Attest:*

DONALD J. QUIGG

*Attesting Officer*

*Acting Commissioner of Patents and Trademarks*